United States Patent [19]

Yamada

[11] Patent Number: 4,583,813

[45] Date of Patent: Apr. 22, 1986

[54] LOW PROFILE ELECTRICAL CONNECTOR ASSEMBLY

[75] Inventor: Hiromi Yamada, Yokosuka, Japan

[73] Assignee: AMP Incorporated, Harrisburg, Pa.

[21] Appl. No.: 665,326

[22] Filed: Oct. 26, 1984

Related U.S. Application Data

[63] Continuation-in-part of Ser. No. 651,549, Sep. 17, 1984, which is a continuation of Ser. No. 341,954, Jan. 22, 1982, Pat. No. 4,474,418.

[30] Foreign Application Priority Data

Nov. 16, 1983 [JP] Japan ..... 58-214175

[51] Int. Cl.[4] ..... H01R 4/24

[52] U.S. Cl. ..... 339/91 R; 339/97 R; 339/176 M

[58] Field of Search ..... 339/97 R, 97 P, 98, 339/99 R, 221 R, 221 M, 176 M, 91 R

[56] References Cited

U.S. PATENT DOCUMENTS

| | | | |
|---|---|---|---|
| 4,040,705 | 8/1977 | Huber | 339/99 R |
| 4,243,289 | 1/1981 | Kozel | 339/176 M |
| 4,255,009 | 3/1981 | Clark | 339/97 P |
| 4,296,988 | 10/1981 | Warner | 339/97 R |
| 4,362,353 | 12/1982 | Cobaugh et al. | 339/221 R |
| 4,474,418 | 10/1984 | Yamada | 339/176 M |
| 4,487,463 | 12/1984 | Tillotson | 339/176 M |

*Primary Examiner*—John McQuade

*Attorney, Agent, or Firm*—Adrian J. LaRue

[57] ABSTRACT

A low profile electrical connector assembly comprises matable first and second dielectric housing members having first and second matable electrical contacts secured respectively therein. The first electrical contact comprises a resilient hooked contact portion disposed about a supporting rib extending from a wall in the first housing member in the mating direction. The second electrical contact comprises a base plate which extends parallel to the mating direction and includes a conductor-connecting portion extending outwardly from the ends of the base plate from one side of the base plate and a contact portion extending outwardly from sides of the base plate from the other side of the base plate so that the contact portion resiliently engages the hooked contact portion in an interference fit when the housings mate together.

8 Claims, 10 Drawing Figures

LOW PROFILE ELECTRICAL CONNECTOR ASSEMBLY

This application is a continuation-in-part application U.S. patent application Ser. No. 651,549 filed Sept. 17, 1984, which in turn is a continuation of U.S. patent application Ser. No. 341,954 filed Jan. 22, 1982, now U.S. Pat. No. 4,474,418.

FIELD OF THE INVENTION

The invention relates to an electrical connector assembly and more particularly to a low profile electrical connector assembly for mounting on a printed circuit board.

BACKGROUND OF THE INVENTION

It often desirable that electrical connector assemblies for mounting on printed circuit ;boards be of a low profile, that is, extend only a short distance above the surface of the printed circuit board, to permit a plurality of printed circuit boards to be closely spaced together in densely packed electronic equipment.

A known electrical connector assembly of this type comprises a post header including a row of post contacts secured in a first insulating housing, one end of each post contact extending out of the housing for recepit in a hole in a printed circuit board and the other end of the post contact being turned back to define a resilient hooked portion which extends about a support rib which extends from a wall of the first housing in the mating direction, the free end of the hooked portion being spaced from the wall, and a female connector including a row of female contacts secured in a second insulating housing, each female contact having a fork contact at one end and a wire-connecting portion at the other end, the fork contact of the female contact resiliently engaging the corresponding hooked portion of the post contact when the female connector and the post header are mated.

The advantage of this known electrical connector is that the resilient hooked portion of the post contact provides relatively small resistance to insertion in the forked female contact, which may, therefore, have relatively short forked arms so that a low profile female connector can be realized.

However, the female contact of the known electrical connector assembly has a contact portion and a wire-connecting portion which are aligned in the longitudinal direction; therefore, the female contact has a long length, thereby preventing the electrical connector assembly from having a low profile.

SUMMARY OF THE INVENTION

An object of the present invention is to provide an electrical connector assembly which includes a low profile female electrical connector.

According to the present invention, an electrical contact of a female electrical connector of a low profile electrical connector assembly includes a base plate which extends parallel to the mating direction, the base plate having a contact portion extending outwardly from a first surface and a conductor-connecting portion extending outwardly from a second surface thereof, the contact portion and the conductor-connecting portion being substantially coplanar with respect to the mating direction of the contact.

Also, according to the present invention, a low profile electrical connector assembly comprises matable first and second dielectric housing members ;having first and second matable electrical contacts secured respectively therein. The first electrical contact comprises a resilient hooked contact portion disposed about a supporting rib extending from a wall in the first housing member in the mating direction. The second electrical contact comprises a base plate which extends parallel to the mating direction and includes a conductor-connecting portion extending outwardly from the ends of the base plate from one side of the base plate and a contact portion extending outwardly from sides of the base plate from the other side of the base plate so that the contact portion resiliently engages the hooked contact portion in an interference fit when the housing members mate together.

BRIEF DESCRITION OF THE DRAWINGS

DETAILED DESCRIPTION OF THE INVENTION

Figure 1:
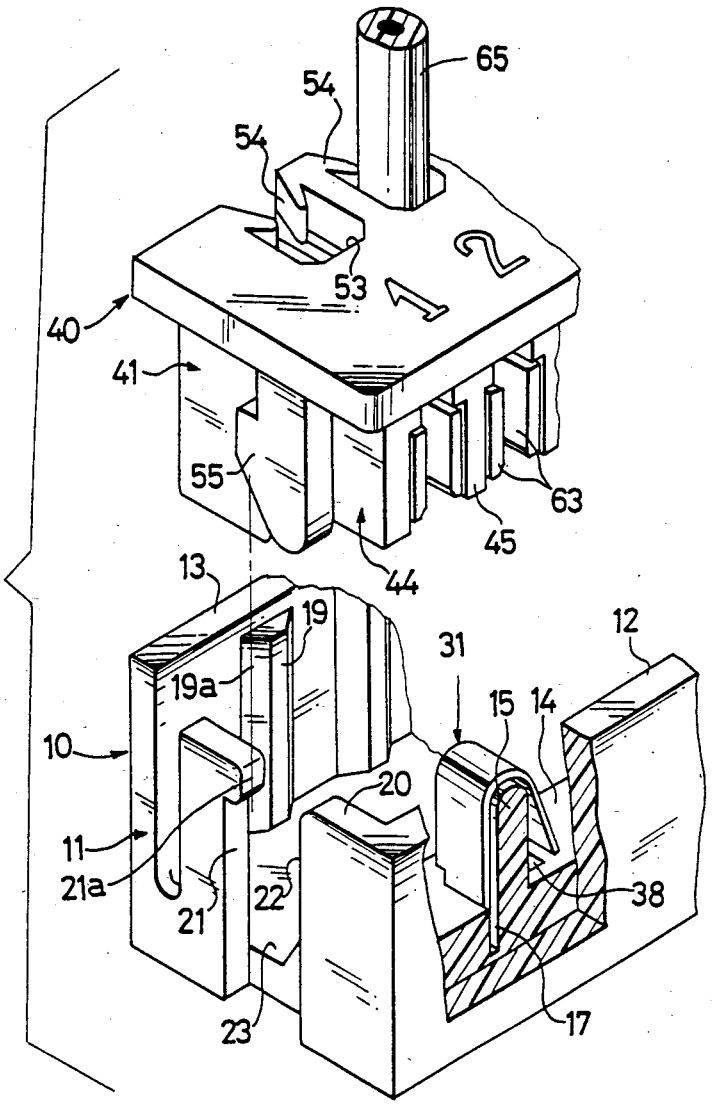
FIG. 1 is a part perspective view of the electrical connector assembly according to the invention.
Figure 2:
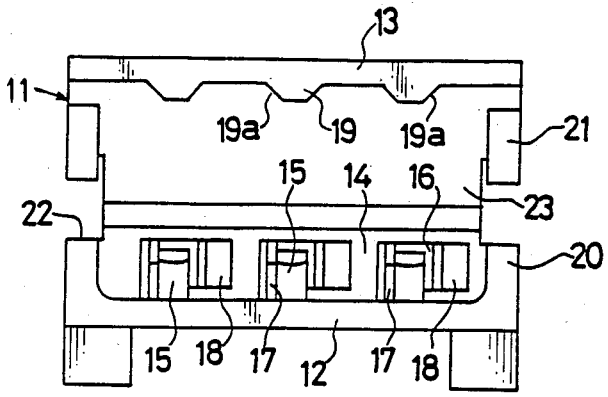
FIG. 2 is a top plan view of the first insulating housing.
Figure 3:
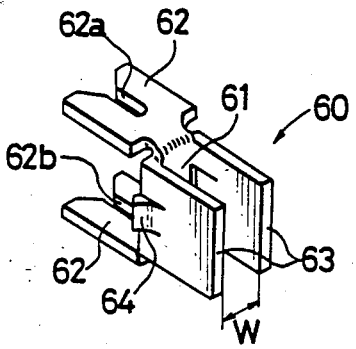
FIG. 3 is a perspective view of the female contact.

The electrical connector assembly according to the present invention comprises a post header 10 and a female connector 40 matable to the post header, as shown in FIG. 1. Post header 10 comprises a first insulating housing 11 molded into one piece from a suitable dielectric matreial which has desirable strength and dielectric characteristics and includes a pair of opposed walls 12 and 13. A step 14 is formed along the inside of wall 12 and has thereon a plurality of contact-supporting ribs 15 which extend upwardly from step 14 in a mating direction and which are equidistantly spaced from each other, one side of each rib 15 being integral with side wall 12. As shown in FIG. 2, an L-shaped post-inserting aperture 16 and a slot 17 are formed about the base of each supporting rib 15. Also, a post contact-supporting recess 18 is formed adjacent to each L-shaped aperture 16 on step 14.

The other side wall 13 has along an inside surface thereof a plurality of equidistantly-spaced projections 19 extending parallel to the mating direction, as shown in FIGS. 1 and 2. Each projection 19 includes a pair of inclined surfaces **19*a* which guide female connector 40 (to be described later) during mating engagement with post header 10. Projections 19 also serve to prevent female connector 40** from being mismated.

Post header 10 has at both ends resilient arms 21, each arm 21 having a latching projection **21*a*, and a space 22 formed between each resilient arm 21** and an end wall 20 extending from side wall 12, the space 22 receiving a latching arm 55 (described later).

Figure 7:
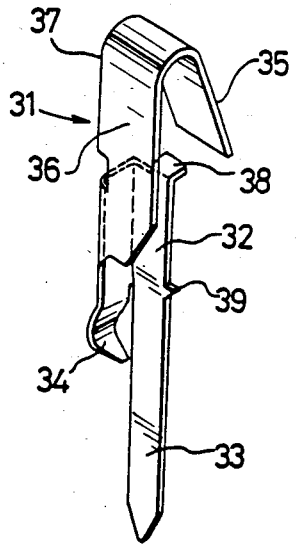
FIG. 7 is a perspective view of the male contact.

Post contact 31, shown in FIG. 7, is stamped and formed from a metal strip having desirable conductive and spring characteristics which comprises a terminal portion 33 and a short leg 34 extending downward and from which a resilient contact portion 37 extends upward. Resilient contact portion 37 includes a vertical portion 36 and an arcuate portion which forms a contact portion as a resilient hook 35. As can be seen from FIG. 7, the free end of resilient hook 35 normally diverges from vertical portion 36. The part of the base 32 having terminal portion 33 is provided, at its upper end, with a lug 38 which is bent outwardly at a right angle and a barb 39 at the lower portion of base 32.

Figure 8:
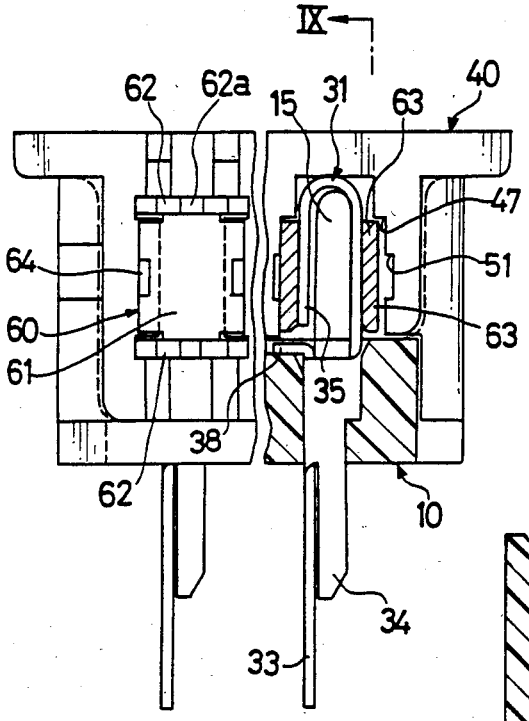
FIG. 8 is a part cutaway side elevational view of the mated electrical connector assembly.
Figure 9:
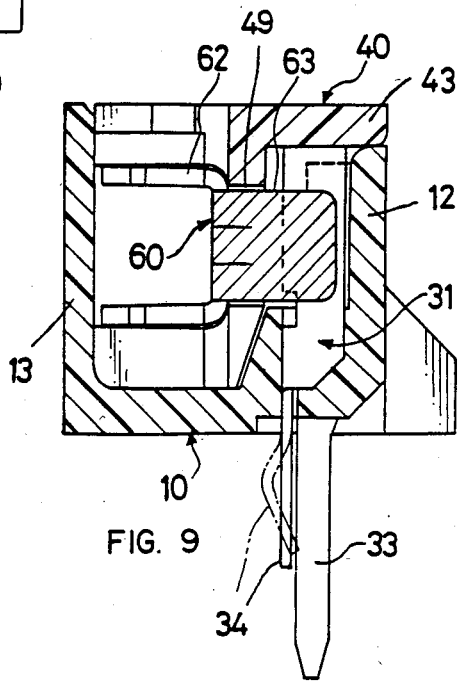
FIG. 9 is a cross-sectional view taken along the line IX—IX of FIG. 8.
Figure 10:
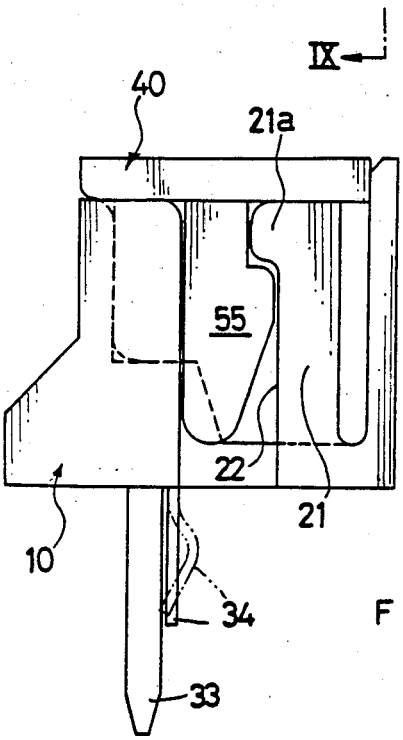
FIG. 10 is a side elevational view of the mated electrical connector assembly.

Post contacts 31 are each inserted into first housing 11 with terminal portions 33 and short legs 34 disposed in L-shaped apertures 16, with vertical portions 36 disposed in slots 17 as a force fit. As a result, lugs 38 of post contacts 31 are disposed in respective post contact-supporting recesses 18, and barbs 39 dig into the walls of apertures 16 thereby securing post contacts 31 in housing 11. Resilient hooked contact portions 37 extend about respective supporting ribs 15 as shown in FIGS. 1 and 8. Short legs 34 protruding from the bottom surface of housing 11 with terminal portions 33 are subsequently bent into an arcuate shape as shown in FIGS. 9 and 10. These arcuately-shaped legs 34 resiliently engage the inner surface of the holes of a printed circuit board when legs 34 and terminal portions 33 are inserted into the holes of the printed circuit board so that post header 10 is frictionally mounted on the printed circuit board, whereafter legs 34 and terminal portions 33 are flow-soldered to the conductive paths of the boards.

Figure 4:
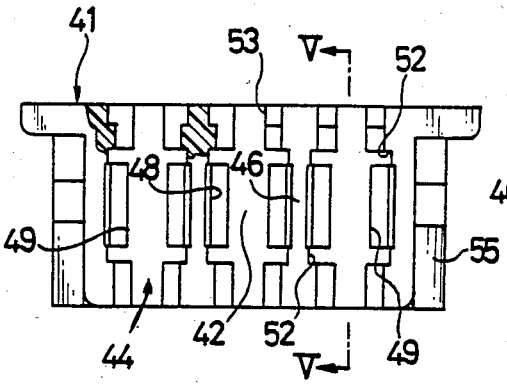
FIG. 4 is a part cutaway bottom plan view of the second insulating housing.
Figure 5:
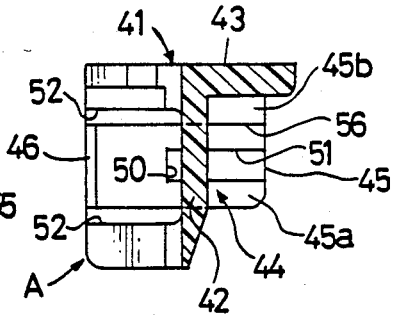
FIG. 5 is a cross-sectional view taken along the line V—V of FIG. 4.
Figure 6:
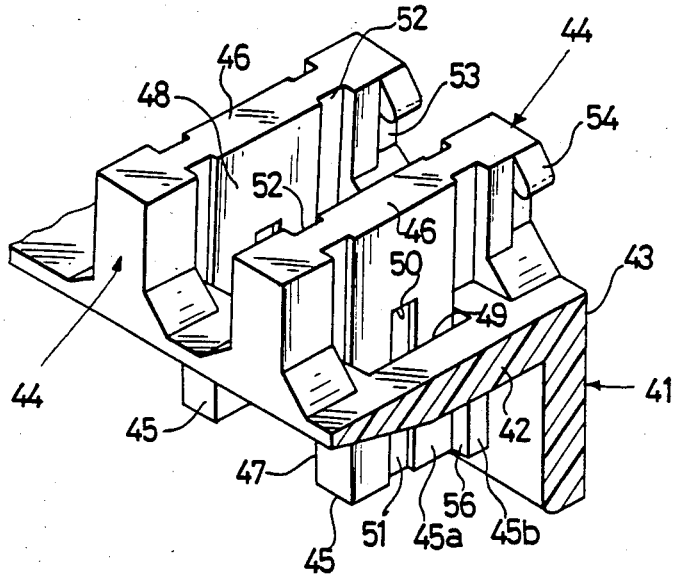
FIG. 6 is a part perspective view of FIG. 5 seen in the direction of the arrow A.

Female connector 40 comprises a second insulating housing 41 molded in one piece from a suitable material having desirable dielectric and strength characteristics and includes base 43 from which extends a vertical wall 42 extending in the mating direction. A plurality of separating walls 44 intersect at right angles to vertical wall 42, as shown in FIGS. 4 through 6. Each separating wall 44 comprises an inner wall 45 extending inwardly along base 43 from vertical wall 42 and an outer wall 46 extending outwardly therefrom. A pair of adjacent inner walls and outer walls from therebetween a first contact cavity 47 and a second contact cavity 48, respectively, which communicate through a rectangular opening 49 extending through vertical wall 42.

Each outer wall 46 has at the lower central portion of its inside surface a surface 50 for contact retention, surface 50 being formed by a channel 51 extending to the end of inner wall 45. A pair of recesses 52 is formed at both sides of outer wall 46. Each pair of recesses 52 is opposite another pair of recesses 52 of adjacent outer walls 46. A pair of outer walls 46 form at one end a U-shaped slot 53 (FIG. 1) which receives an insulated electrical conductor 65 and which has a pair of opposite projections 54 extending inward. The pair of projections 54 prevent conductor 65 inserted into the slot 53 from coming out of the slot. Each inner wall 45 has on its surface 45*a* a step 45*b* which provides a shoulder 56.

The ends of second insulating housing 40 are provided with flexible latching arms 55 (FIG. 1), each arm 55 being inserted into space 22 on post header 10 to engage with latching projection 21*a* of resilient arm 21, whereby both housings 10 and 40 are latched together when mated as shown in FIG. 10.

Female contact 60 accommodated in second housing 41 is made from a metal strip having desirable conductive and spring characteristics by stamping and forming and includes a rectangular base plate 61 which extends parallel to the mating direction. Base plate 61 has a conductor-connecting portion and a contact portion. The conductor-connecting portion comprises a pair of parallel plates 62 which have conductor-receiving slots 62*a*, 62*b*, respectively, and which extend at right angles from an upper end and a bottom end perpendicular to the mating direction of plate 61. The contact portion comprises a pair of parallel arms 63 which extend at right angles from the sides of base plate 61 and extend in a direction opposite that of the conductor-connecting portion. Thus, contact arms 63 have contact surfaces that extend parallel to the mating direction when female contact 60 mates with post contact 31. Each contact arm 63 is provided at its inner central portion with a retention lance 64 extending outwardly. The minimum width (W) of the pair of contact arms 63 is slightly larger than the sum of the thickness of the supporting rib 15 plus twice the stock thickness of the hooked contact portion 37. Thus, the height of female contact or terminal 60 is confined to the length of plate 61.

In mounting each contact 60 in housing 41, contact 60 is inserted into housing 41 such that the free ends of contact arms 63 pass through respective apertures 49 of housing 41 and the edges of conductor-connecting arms 62 are disposed in recesses 52 of outer walls 46 as shown in FIG. 8. As a result, contact arms 63 extend into the first contact cavity 47 so that one edge portion of each contact arm 63 engages with a respective shoulder 56 and each retention lance 64 thereof resiliently engages with a respective surface 50 of channels 51 so that contact arms 63 and conductor-connecting arms 62 are retained in the first contact cavity 47 and in the second contact cavity 48, respectively. Female connector 60 is terminated to an insulated electrical conductor 65 via conductor-receiving slots 62*a*, 62*b* in a conventional manner.

On mating female connector 40 with post header 10, resilient hooked contact portion 37 of each post contact 31 is received as an interference fit within the pair of contact arms 63 of female contact 60. The maximum resilient deflection occurs at the free end of the hooked contact portion 37 which provides a low resistance to insertion and a reliable electrical and mechanical connection. Also, latching arm 55 of female connector 40 engages resilient arm 21 of post header 10 so that female connector 40 and post header 10 are latchably mated together.

According to the present invention, since the female contact is constructed such that the conductor-connecting portion and the post-contacting portion are substantially coplanar with respect to the mating direction, there are advantages in that the female contact height can be shorter; therefore, a low profile female connector is realized. Thus, the electrical connector assembly can be accommodated in small spaces. Also, the female contact is simple in construction and can be made economically without wasting material so that the manufacturing cost can be substantially reduced. Moreover, contact arms 63 engage hooked contact portion 37 over a large contact area and the resilient forces generated between hooked contact portion 37 and contact arms 63 when in an engaged position are substantial. The construction of hooked contact portion 37 enables contact arms 63 to initially engage contact portion 37 with a low insertion force which gradually increases until complete contact engagement takes place between hooked contact portion 37 and contact arms 63. At this point, maximum contact pressure takes place resulting in an excellent mechanical and electrical connection. Also, as contact arms 63 and hooked contact portion 37 are moving relative to one another, wiping action is taking place therebetween which cleans the contact surfaces therebetween.

I claim:

1. An electrical connector, comprising:

a first insulating housing member having a supporting-rib member extending outwardly from an upper surface of said first housing member in a mating direction, a first electrical contact member secured in said first housing and including a contact section in the form of a resilient hook member disposed about said supporting-rib member; and a second insulating housing member matable with said first housing member, a second electrical contact member secured in said second housing member, said second contact member includes a base plate extending parallel to the mating direction and having a conductor-connecting portion and a contact portion, said conductor-connecting portion extending to one side of said base plate for electrical connection to an electrical conductor so that the electrical conductor extends in the same direction as the mating direction and said contact portion extending to the other side of said base plate opposite the direction of said conductor-connecting portion and defining parallel contact arms that have contact surfaces extending in the same direction as the mating direction and which mechanically engage respective surfaces of said resilient hook member therealong in an interference fit thereby electrically connecting the first electrical contact member with the second electrical contact member when the first and second housing members are mated.

2. An electrical connector according to claim 1, wherein latching means are provided on said housing members for latching said housing members together when they are mated.

3. An electrical connector according to claim 1, wherein the height of the second electrical contact member is confined to that of said base plate.

4. An electrical connector according to claim 1, wherein said conductor-connecting portion includes parallel plates extending outwardly from respective ends of said base plate and having conductor-terminating slots therein and said contact arms extending outwardly from respective sides of said base plate.

5. An electrical connector according to claim 1, wherein said first electrical contact member includes a terminal portion and a short leg extending outwardly from a surface of said first housing member, said terminal portion and said short leg being disposable in a hole of a printed circuit board and being electrically connectable to a circuit path on the printed circuit board, said short leg having an arcuate configuration to frictionally engage the hole and maintain the first housing on the board.

6. An electrical terminal, comprising:

a base plate having a conductor-connecting portion and a contact portion, said conductor-connecting portion defining substantially parallel conductor-terminating members extending outwardly from first opposite edges of said base plate in a first direction and having aligned conductor-terminating means for terminating an electrical conductor therein so that the terminated section of the electrical conductor extends along said base plate, said contact portion defining substantially parllel contact arms extending outwardly from second opposite edges of said base plate between respective first opposite edges in a second direction opposite to said first direction, said contact arms having contact surfaces extending along the same direction as said base plate whereby the terminal will mate with a complementary contact section of an electrical contact member by reception of the contact section between the contact surfaces by movement of the terminal in the same direction as that of the terminated section of the electrical conductor.

7. An electrical terminal as claimed in claim 6, wherein the height of said terminal is confined to the length of said base plate.

8. An electrical terminal as claimed in claim 6, wherein said conductor-terminating means comprise slots in said conductor-terminating members.

* * * * *